United States Patent [19]

Shinomura

[11] Patent Number: 4,751,937

[45] Date of Patent: Jun. 21, 1988

[54] METHOD OF REDUCING FRICTION LOSSES IN FLOWING LIQUIDS

[75] Inventor: Toshihiko Shinomura, Yokohama, Japan

[73] Assignee: Nippon Oil Co., Ltd., Minato, Japan

[21] Appl. No.: 866,496

[22] PCT Filed: Sep. 3, 1985

[86] PCT No.: PCT/JP85/00491

§ 371 Date: May 9, 1986

§ 102(e) Date: May 9, 1986

[87] PCT Pub. No.: WO86/02129

PCT Pub. Date: Apr. 10, 1986

[30] Foreign Application Priority Data

Oct. 3, 1984 [JP] Japan ..... 59-207652

[51] Int. Cl.[4] ..... F17D 1/16

[52] U.S. Cl. ..... 137/13; 252/8.551

[58] Field of Search ..... 252/8.551; 137/13

[56] References Cited

U.S. PATENT DOCUMENTS

| | | | |
|---|---|---|---|
| 3,843,589 | 10/1974 | Wartman | 137/13 X |
| 3,938,536 | 2/1976 | Metzner et al. | 137/13 |
| 4,263,926 | 4/1981 | Drake et al. | 137/13 |
| 4,341,684 | 7/1982 | Krantz | 137/13 |
| 4,524,158 | 6/1985 | Barber | 252/8.512 X |
| 4,524,159 | 6/1985 | Barber | 252/8.512 X |

*Primary Examiner*—Herbert B. Guynn

*Attorney, Agent, or Firm*—Bucknam and Archer

[57] ABSTRACT

A method of reducing friction losses in aqueous and nonaqueous liquids is disclosed. A certain polymeric material has heretofore been admixed to this end with flowing liquids, such polymer being dissolvable to form a solution. The prior art method is effective for friction loss reduction, but has a drawback in that the polymer is susceptible to scission of its chains under shear stress and hence is unstable in the solution. The invention disclosed is based on the discovery that friction losses in liquids can be reduced with maximum stability by adding to a liquid a predetermined amount of selected organo-polymeric microfibrils which are insoluble but highly dispersible in the liquid. The method of the invention may be applied for instance in the transport of various liquids and crude oils through pipelines and also in the circulation of aqueous and nonaqueous lubricants.

1 Claim, No Drawings

METHOD OF REDUCING FRICTION LOSSES IN FLOWING LIQUIDS

FIELD OF THE INVENTION

This invention relates to a method of reducing friction losses in flowing liquids.

PRIOR ART

It is known that friction loss in flowing liquids can be reduced by intermixing therewith small amounts of a certain soluble polymeric material. In such instance, the polymeric material dissolves in the liquid and forms a solution. When the solution is conducted through a pipeline or other restricted space, the dissolved polymers serve to eliminate or alleviate the tendency of the flow of the solution to become turbulent; that is, to maintain the flow laminar so as to minimize friction loss. This is the phenomenon called the TOMS effect after the discoverer.

The prior art method, however, is not quite satisfactory in that the polymer is susceptible to scission of its chains due to shear stress applied during flow of the solution, leading to instability in the solution. This problem has yet to be solved despite many attempts that have been made with different kinds of polymers.

The present invention seeks to provide a method of reducing friction losses in flowing liquids which is free of the foregoing problem and which can exhibit excellent stability in a given liquid.

SUMMARY OF THE INVENTION

According to the invention, there is provided a method of reducing friction losses in flowing liquids, characterized by adding to a liquid an organo-polymeric microfibril material in an amount of 0.1 ppm–5 percent by weight of said liquid, said material being insoluble and highly dispersible in said liquid.

BEST MODE OF EMBODYING THE INVENTION

The term liquid as used herein includes aqueous or nonaqueous liquids such as oils, lubricants, aqueous lubricants, crude oil, petroleum fractions, solvents and the like.

The term organo-polymeric microfibril as used herein designates a solid organic polymer in the form of microfibrils having an average diameter in the range of 10 Å–5 μm, preferably 50 Å–1 μm, more preferably 100 Å–1,000 Å, an average length in the range of 1,000 Å–3 mm, preferably 1 μm–500 μm, and an aspect ratio (length/diameter) of 10–1,000,000.

Polymeric microfibrils of diameters smaller than 10 Å are difficult to make and if not, would be susceptible to scission under shear stress when added to a liquid. Greater diameters than 5 μm would invite precipitation of the microfibrils in the liquid.

Polymeric microfibrils of lengths less than 1,000 Å would fail to suppress turbulence in the flowing liquid. Greater lengths than 3 mm would result in coagulated, precipitated microfibrils in the liquid.

Polymeric microfibrils of aspect ratios smaller than 10 would be ineffective for turbulence reduction. Excessive aspect ratios would lead to entanglement of individual microfibrils and hence precipitation in the flowing liquid.

Polymeric materials to be processed into microfibrils according to the invention should be insoluble but highly dispersible in a given liquid. There may be used for example polyethylene, polypropylene, polystyrene, polyvinyl chloride, polyvinylidene chloride, polytetrafluoroethylene, polyethylene terephthalate, polymethylmethacrylate, nylon, polycarbonate and copolymers or blends thereof.

Polymeric compounds known for their heat resistance may also be used which include aromatic polyamides, aromatic polyethers, polyetheretherketones, aromatic polyesters, aromatic polyimides and polybenzoimidazoles.

Other polymeric materials that have been found particularly preferable are those which are capable of forming a liquid crystal. Specific examples include aramide fibers such as poly-p-phenylene terephthalamide wet spun from sulfuric acid liquid crystal solution and polybenzobisthiazole wet spun from polyphosphoric acid liquid crystal solution.

Microfibrils formed from polymeric solutions or melts in a liquid crystal state have high molecular orientation and hence high strength so that when placed in a liquid, they can resist scission against increased shearing force applied during flow of the liquid.

By "highly dispersible" is meant the state of polymeric microfibrils which can be determined by an experiment in which 100 ppm of a polymeric microfibril material is added to the liquid and stirred vigorously for five hours, and thereafter 200 ml of the resulting suspension is taken into a tapped, graduated cylinder of Grade No. 200 (inside diameter 37 mm, capacity 200 ml) and held still for one hour. If the amount of the polymeric material that has precipitated is less than 50 ppm, then this is taken to mean that the material is highly dispersible. A choice of polymeric microfibril materials depends upon a particular kind of liquid in which they are used.

What is meant by the microfibrils being "insoluble" in a liquid may be determined by an experiment in which 5 weight percent of a polymeric microfibril material is added to the liquid and stirred vigorously for five hours at a working temperature, followed by filtration and drying, whereupon the material is measured for weight reduction. If this reduction is less than 10 weight percent of the original weight, then the microfibril material is regarded as insoluble.

There is no restriction imposed upon how to make the polymeric microfibril material. It may be spun by jet stream from polymeric melts, or formed by mechanical grinding of polymeric fibers, or prepared by dropwise addition of a polymeric solution to a coagulated liquid under high speed agitation or supersonic radiation. These methods may be combined at will.

The above described methods are also applicable to polymeric solutions or melts in a liquid crystal state. Fibers obtained by liquid crystal spinning may be cut and ground, in which instance the fibers may be ground while being swollen.

In order to improve dispersibility of the microfibril material in a liquid and also to enhance stability of the resultant suspension, the material may be treated with a suitable surfactant, or chemically modified, or physically treated as by corona discharge.

The rate of the polymeric microfibril material to be added is in the range of 0.1 ppm–5 percent, preferably 1 ppm–1 percent.

Smaller amounts would fail to inhibit turbulent flow, and larger amounts would lead to coagulation and hence precipitation.

The method of the invention finds effective application where the liquid is transported through a pipeline, particularly when its Reynolds number exceeds 1,000. The Reynolds number is one which can be determined from a radius of a pipe with respect to a kinematic viscosity and a velocity of a liquid to be flowed through the pipe, a diameter of the pipe and the like. In the case of lubrication of bearings in large, high-speed industrial machinery, the lubricant has a Reynolds number usually in excess of 1,000 or even 2,000 beyond the critical limit of a laminar flow; therefore, increased power would be required to compensate for friction losses, or sometimes the bearings would get overheated, affecting the stability or service life of the equipment. The invention is directed to elimination or alleviation of such adverse situations.

The invention will be further described by way of the following examples.

COMPARISON EXAMPLE 1

A homogeneous solution was prepared by dissolving polyisoprene in cyclohexane under conditions shown in Table 1. The solution was circulated by a metering pump through a circular loop of pipe of the dimensions indicated in Table 1 at the rate of flow and temperature tabulated. Pressure drop across the loop was measured by pressure gages each at the inlet and outlet of the pump. The rate of reduction of friction loss in the circulating solution may be determined by the equation:

$$\text{Friction Loss Reduction Rate } A = \frac{\Delta Po - \Delta P}{\Delta Po} \times 100\ (\%)$$

where ΔP is a pressure drop with an additive (polyisoprene in the case of Comparison Example 1) and ΔPo is a pressure drop without such additive. Rate A is a parameter representing the TOMS effect that turbulent flow is suppressed. Rate A in Comparison Example 1 was quite satisfactory in the first cycle of circulation of the liquid, but sharply declined with 1,000 cycles of circulation due to scission of polyisoprene molecules under the influence of shear stress.

INVENTION EXAMPLE 1

A stable suspension was prepared by adding polypropylene microfibrils to cyclohexane as shown in Table 1 and tested in a manner similar to Comparison Example 1. Rate A was by far more satisfactory than that in Comparison Example 1 especially after 1,000 cycles of circulation of the liquid. This is believed to be due to polypropylene being in the form of microfibrils which are highly resistant to shear stresses, as contrasted to polyisoprene being of a molecular order.

INVENTION EXAMPLE 2

A stable suspension was prepared, as shown in Table 1, by blending cyclohexane with polymeric microfibrils of aramide (DuPont's "Kevlar 49", liquid crystal spun polymer, poly-p-phenylene terephthalamide). The suspension was subjected to the same test as in Comparison Example 1. Rate A was quite satisfactory with the same levels of reduction exhibited in the first cycle and after 1,000 cycles of circulation, and yet was excellent as compared to that in Invention Example 1. This is believed to accrue from high strength of this polymeric microfibril material.

INVENTION EXAMPLES 3–5

As shown in Table 2, Murban crude oil was added with aramide microfibrils (DuPont's "Kevlar" 49") to make stable suspensions. The respective suspensions were tested using the temperature, flow rate and pipe tabulated. Rate A was quite satisfactory in each instance without declining even after 1,000 cycles of circulation.

INVENTION EXAMPLES 6–9

To turbine oil was added microfibrils of "Kevlar" aramide, high density polyethylene, polyethylene terephthalate and nylon-6, respectively, as shown in Table 3. The respective suspensions were tested for friction loss reduction with results tabulated.

Rate A was quite satisfactory in each instance. Particularly excellent were the suspensions in which "Kevlar" microfibrils were used. Rate A showed no appreciable decline even after 1,000 cycles of circulation.

INDUSTRIAL APPLICABILITY

The method of the invention can reduce friction losses in the transport or circulation of various liquids. It may be applied for instance in the transport of crude oils from oil-wells through pipelines to tankers or tankers to storage tanks, thereby saving energy required to transport the crude oils and further providing increased flow rates. It may also be applied to the circulation of lubricating oils such as turbine oils, gear oils, compressor oils and bearing oils whereby high-load, high-speed operation can be stably maintained for prolonged periods of time.

TABLE 1

| Example | Base liquid | Additive | Inside diameter and length of pipe | Temp. (°C.) | Flow rate (l/min.) | Friction loss reduction rate (%) After 1st cycle of circulation | Friction loss reduction rate (%) After 1,000 cycles of circulation |
|---|---|---|---|---|---|---|---|
| Comparison Example 1 | Cyclohexane | Polyisoprene (average MW: 400,000) 400 ppm added Dissolved and homogeneous solution formed | ϕ3.63 mm 1.2 m | 25 | 50 | 11 | 2.5 |
| Invention Example 1 | Cyclohexane | Polypropylene microfibrils (diameter: 200Å, length: 12 μm) 400 ppm added Not dissolved and stable suspension formed | ϕ3.63 mm 1.2 m | 25 | 50 | 13 | 6.5 |
| Invention Example 2 | Cyclohexane | "Kevlar" microfibrils (diameter: 150Å, | ϕ3.63 mm 1.2 m | 25 | 50 | 16 | 16 |

TABLE 1-continued

| Example | Base liquid | Additive | Inside diameter and length of pipe | Temp. (°C.) | Flow rate (l/min.) | Friction loss reduction rate (%) After 1st cycle of circulation | Friction loss reduction rate (%) After 1,000 cycles of circulation |
|---|---|---|---|---|---|---|---|
| | | length: 2 μm)<br>400 ppm added<br>Not dissolved and stable suspension formed | | | | | |

TABLE 2

| Example | Base liquid | Additive | Inside diameter and length of pipe | Temp. (°C.) | Flow rate (l/min.) | Friction loss reduction rate (%) After 1st cycle of circulation | Friction loss reduction rate (%) After 1,000 cycles of circulation |
|---|---|---|---|---|---|---|---|
| Invention Example 3 | Murban crude oil | "Kevlar" microfibrils (diameter: 900Å, length: 450 μm)<br>0.5 ppm added<br>Not dissolved and stable suspension formed | ϕ15.6 cm<br>1.2 m | 25 | 2,980 | 25 | 25 |
| Invention Example 4 | Murban crude oil | "Kevlar" microfibrils (diameter: 10Å, length: 1,200Å)<br>5 wt. % added<br>Not dissolved and stable suspension formed | ϕ15.6 cm<br>5 m | 25 | 2,980 | 67 | 66 |
| Invention Example 5 | Murban crude oil | "Kevlar" microfibrils (diameter: 5 μm, length: 3 mm)<br>1 wt. % added<br>Not dissolved and stable suspension formed | ϕ15.6 cm<br>5 m | 25 | 2,980 | 56 | 56 |

TABLE 3

| Example | Base liquid | Additive | Inside diameter and length of pipe | Temp. (°C.) | Flow rate (l/min.) | Friction loss reduction rate (%) After 1st cycle of circulation | Friction loss reduction rate (%) After 1,000 cycles of circulation |
|---|---|---|---|---|---|---|---|
| Invention Example 6 | Turbine oil* | "Kevlar" microfibrils (diameter: 500Å, length: 200μm)<br>100 ppm added<br>Not dissolved and stable suspension formed | ϕ12.7 mm<br>3 m | 40 | 112 | 75 | 75 |
| Invention Example 7 | Turbine oil* | High density polyethylene microfibrils (diameter: 200Å, length: 20 μm)<br>10 ppm added<br>Not dissolved and stable suspension formed | ϕ12.7 mm<br>3 m | 40 | 112 | 36 | 17 |
| Invention Example 8 | Turbine oil* | Polyethylene terephthalate microfibrils (diameter: 300Å, length: 3,000Å<br>5 ppm added<br>Not dissolved and stable suspension formed | ϕ12.7 mm<br>5 m | 40 | 112 | 22 | 11 |
| Invention Example 9 | Turbine oil* | Nylon-6 microfibrils (diameter: 100Å, length: 1 μm)<br>50 ppm added<br>Not dissolved and stable suspension formed | ϕ12.7 mm<br>3 m | 40 | 112 | 31 | 15 |

*FBK Turbine 32 made by Nippon Oil Co., Ltd.

I claim:

1. A method of reducing friction losses in a flowing liquid, which consists essentially of adding to said liquid an organo-polymeric microfibril material of average diameter 10 Å–5 micrometers, an average length of 1,000 Å–3 mm and an aspect ratio of 10–1,000,000 in an amount of 0.1 ppm–5 percent by weight of said liquid, said material being insoluble and highly dispersible in said liquid and wherein said polymeric material is poly-p-phenylene terephthalamide wet spun from sulfuric acid liquid crystal solution of polybenzobisthiazole wet spun from polyphosphoric acid liquid crystal solution.

* * * * *